US008330034B2

(12) United States Patent
LaBarbera

(10) Patent No.: US 8,330,034 B2
(45) Date of Patent: Dec. 11, 2012

(54) MUSICAL INSTRUMENT WITH SYSTEM AND METHODS FOR ACTUATING DESIGNATED ACCOMPANIMENT SOUNDS

(75) Inventor: Anthony LaBarbera, New Milford, NJ (US)

(73) Assignee: Anthony LaBarbera, New Milford, NJ (US)

( * ) Notice: Subject to any disclaimer, the term of this patent is extended or adjusted under 35 U.S.C. 154(b) by 916 days.

(21) Appl. No.: 12/164,182

(22) Filed: Jun. 30, 2008

(65) Prior Publication Data

US 2009/0007762 A1 Jan. 8, 2009

Related U.S. Application Data

(60) Provisional application No. 60/948,233, filed on Jul. 6, 2007.

(51) Int. Cl.
*G10H 1/40* (2006.01)
*G10H 3/14* (2006.01)

(52) U.S. Cl. ..... 84/612; 84/734

(58) Field of Classification Search ..... 84/610–613, 84/634–637, 650–652, 666–669, 712–715
See application file for complete search history.

(56) References Cited

U.S. PATENT DOCUMENTS 3,375,747 A 4/1968 Posey
3,665,490 A 5/1972 Oskar
3,680,423 A 8/1972 Lander
4,046,048 A * 9/1977 Bione ..... 84/668
4,295,402 A * 10/1981 Deutsch et al. ..... 84/715
4,658,690 A 4/1987 Aitken et al.
4,922,797 A * 5/1990 Chapman ..... 84/650
4,986,157 A 1/1991 Matsubara
5,105,711 A 4/1992 Barnard
5,403,972 A 4/1995 Valentine, Sr.
5,900,573 A 5/1999 Barnes
6,166,307 A 12/2000 Caulkins et al.
6,441,293 B1 8/2002 LaBarbera
7,518,054 B2 * 4/2009 McKinney et al. ..... 84/612

* cited by examiner

*Primary Examiner* — Elvin G Enad
*Assistant Examiner* — Andrew R Millikin
(74) *Attorney, Agent, or Firm* — Kenealy Vaidya LLP

(57) ABSTRACT

A musical accompaniment system is described including a fretted, stringed electric musical instrument, a floor unit, interface units and connecting cables. Designated frets of the instrument are divided into sections that output to a switching component that sends MIDI note # data to a synthesizer when strings of instrument contact designated fret sections. The floor unit includes actuators that output to the synthesizer when tapped by the user. The user taps on the actuators with his or her feet and thereby actuates accompaniment notes that are generated in the rhythms in which they are tapped. Accompaniment notes generated by the process are designated by notes and chords being fingered on the instrument. Methods are described that facilitate the actuating and generating of accompaniment notes in the musical style of traditional bass accompaniment through the use of the system. A method is described to facilitate the system that includes string/fret coordinates that designate appropriate MIDI note # data and accompaniment note for fingering formations of traditional guitar chords used in popular music. Additional methods are described that obviate the generating of extraneous accompaniment notes normally associated with fretted guitar-like instruments. An additional actuator is described that actuates a designated user-programmable bass note or accompaniment sound with each tap by the user on the actuator.

20 Claims, 9 Drawing Sheets

| E-string | A-string | D-string | G-string | B-string |
|---|---|---|---|---|
| Fret E1 | Fret A1 | | | |
| Fret E2 | Fret A2 | Fret D2 | Fret G2 | |
| Fret E3 | Fret A3 | Fret D3 | Fret G3 | Fret B3 |
| Fret E4 | Fret A4 | | | |
| Fret E5 | Fret A5 | | | |
| Fret E6 | Fret A6 | | | |
| Fret E7 | Fret A7 | | | |
| Fret E8 | Fret A8 | | | |
| Fret E9 | Fret A9 | | | |
| Fret E10 | Fret A10 | | | |
| Fret E11 | Fret A11 | | | |
| Fret E12 | Fret A12 | | | |

FIG. 5

| FRET X | FRET Y | MIDI NOTE # | NOTE |
|---|---|---|---|
| Fret A2 | Fret D2 | 28 | E |
| Fret D3 | Fret G2 | 29 | F |
| Fret D2 | Fret G2 | 33 | A |
| Fret G2 | Fret B3 | 38 | D |

FIG. 6A

| FRET Z | MIDI NOTE # | NOTE |
|---|---|---|
| Fret A3 | 28 | E |
| Fret G3 | 29 | F |
| Fret G3 | 33 | A |
| Fret G3 | 38 | D |

FIG. 6B

| FRET X | FRET Y | MIDI NOTE # | NOTE |
|---|---|---|---|
| | Fret E1 | 29 | F |
| Fret E1 | Fret E2 | 30 | Gb |
| Fret E2 | Fret E3 | 31 | G |
| Fret E3 | Fret E4 | 32 | Ab |
| Fret E4 | Fret E5 | 33 | A |
| Fret E5 | Fret E6 | 34 | Bb |
| Fret E6 | Fret E7 | 35 | B |
| Fret E7 | Fret E8 | 36 | C |
| Fret E8 | Fret E9 | 37 | Db |
| Fret E9 | Fret E10 | 38 | D |
| Fret E10 | Fret E11 | 39 | Eb |
| Fret E11 | Fret E12 | 28 | E |

| | | | |
|---|---|---|---|
| | Fret A1 | 34 | Bb |
| Fret A1 | Fret A2 | 35 | B |
| Fret A2 | Fret A3 | 36 | C |
| Fret A3 | Fret A4 | 37 | Db |
| Fret A4 | Fret A5 | 38 | D |
| Fret A5 | Fret A6 | 39 | Eb |
| Fret A6 | Fret A7 | 28 | E |
| Fret A7 | Fret A8 | 29 | F |
| Fret A8 | Fret A9 | 30 | Gb |
| Fret A9 | Fret A10 | 31 | G |
| Fret A10 | Fret A11 | 32 | Ab |
| Fret A11 | Fret A12 | 33 | A |

FIG. 7

| PRESET NAME | F | Gb | G | Ab | A | Bb | B | C | Db | D | Eb | E |
|---|---|---|---|---|---|---|---|---|---|---|---|---|
| ABC | X | X | X | X | ON | X | ON | ON | X | X | X | X |
| ABDE | X | X | X | X | ON | X | ON | X | X | ON | X | ON |
| FGC | ON | X | ON | X | X | X | X | ON | X | X | X | X |
| GCDE | X | X | ON | X | X | X | X | ON | X | ON | X | ON |
| Ab B E | X | X | X | ON | X | X | ON | X | X | X | X | ON |

FIG. 9

MUSICAL INSTRUMENT WITH SYSTEM AND METHODS FOR ACTUATING DESIGNATED ACCOMPANIMENT SOUNDS

This application and invention claim the priority benefit under 35 U.S.C. §119 of U.S. Provisional Patent Application No. 60/948,233 filed on Jul. 6, 2007, which is hereby incorporated in its entirety by reference.

FIELD OF THE INVENTION

The invention relates to a music system and method and, in particular, systems and methods to facilitate the generation of accompaniment sounds in relation to the notes and/or chords being designated on a musical instrument.

BACKGROUND OF THE INVENTION

1. Terminology

Fingering of Chords

In standard guitar playing technique, the term fingering a chord is commonly used to refer to the act of simultaneously pressing a plurality of guitar strings to its frets while arranging the pressing fingers in an order that comprises the notes of the designated chord. The act of fingering a note or chord does not refer to or include the act of strumming or plucking the strings. For right-handed players, the act of fingering is accomplished with the left hand of the player while the act of strumming or plucking is accomplished with the right hand.

The terms finger, fingering or fingered are used in the traditional way throughout the description and refer only to the pressing of the instrument strings to the instrument frets, not to the strumming or plucking of the strings. When a string is pressed against a particular fret, a particular note is generated if that string were then plucked. The notation used is the string, e.g., E, A, D, etc., followed by the fret number (i.e., 1, 2, etc.). Thus, "A2" means finger the "A" note string at the second fret, "E3" means finger the E-note string at the third fret, etc. The designated note is then inferred from this notation (e.g., A2 implies that a B note is designated by the fingering, E3 implies that a G note is designated by the fingering). Finger arrangements for chords are commonly referred to as chord forms, chord formations or fingering formations. The guitar technique referred to herein is the traditional guitar technique as described in standard instruction books such as Mel Bay's Modern Guitar Method Grade 1, The Mel Bay Rhythm Guitar Chord System and Mel Bay Guitar Chords from Mel Bay Publications, Inc.

Presets

In many commercially available Musical Instrument Digital Interface ("MIDI") devices, groupings of data such as MIDI parameters that are stored in the unit memory and accessed as a group by the user are commonly referred to as presets. Certain parameters of this disclosure are programmed by the designer or the user and stored as presets.

MIDI Note #'s and Sharps

The commonly used term MIDI note number will be written herein as MIDI note #. In order to avoid confusion, the # character, commonly referred to as the pound sign, is not used herein to refer to a sharp note as it is commonly used in traditional musical notation. In the present description, notes are designated by using their flat equivalents with the traditional musical notation b after the respective note letter. The term sharp is not used herein. The # character is used herein only to refer to number.

Guitar

The guitar instrument to which reference is made herein is the equivalent of a standard six-string electric guitar that includes components of a guitar such as the Fender Stratocaster or Gibson J-160E and is tuned to standard guitar tuning as described in Mel Bay's Modern Guitar Method Grade 1 unless otherwise described or depicted herein.

2. Discussion of the Related Art

The primary use of the guitar is to provide chord accompaniment for a vocal. When playing chords on a traditional six-string guitar, bass accompaniment can be added only through the use of a live bassist or the use of any of several commercially available accompaniment devices. Use of such devices requires the instrumentalist's musical performance to follow a preprogrammed accompaniment track, and spontaneity is often limited.

Commercially available devices commonly known as guitar synthesizers are electronic guitar systems that reproduce the sounds of other instruments as a guitar is played. Guitar synthesizers utilize a pitch-to-midi technology that responds only to a well-executed picking or finger-picking of individual notes. Guitar synthesizers available from Roland Corporation can perform the task of providing a bass note accompaniment for a note or series of notes played on a guitar to which the synthesizer is connected, but cannot be used to efficiently provide a traditional bass accompaniment when the user is playing chords.

Another commercially available device that is used to generate bass sounds from the playing of guitar notes is commonly referred to as an octave box. Octave boxes cannot produce bass notes from the playing of a chord or chords.

Split-fretted stringed instruments such as U.S. Pat. No. 4,658,690 to Aitken and U.S. Pat. No. 4,986,157 to Matsubara are designed to utilize the instrument as a guitar synthesizer, that is, to actuate synthesized notes that have rhythms that directly reflect the rhythms that are being played on the instrument by strumming or plucking the strings. Such rhythms are inappropriate for simulating traditional bass accompaniment that typically follows the rhythm that is played on the bass drum by the drummer of the ensemble with his or her foot in a rhythm that is counter to that being played by the guitarist of the ensemble.

SUMMARY OF THE INVENTION

Accordingly, the present invention is directed to a musical instrument, system and methods to generate appropriate accompaniment sounds by the tapping of an actuator, which generates the accompaniment sounds relating to the notes and/or chords being fingered on the musical instrument and independent of the rhythm being played on the instrument.

A fretted instrument is used to designate the MIDI note #'s for bass notes or accompaniment sounds when the user fingers commonly used chords on the instrument. In a preferred embodiment, a solid or hollow-body guitar is used; however, it is understood that other fretted instruments may also be used to practice the invention. The bass notes and/or accompaniment sounds are prerecorded and preprogrammed into the synthesizer microchip and actuated in rhythms that are tapped out on actuators, e.g., by the user's foot or feet. Methods are included that are designed to facilitate the actuating of notes and rhythms that are characteristic of traditional bass accompaniment and to obviate the problems that arise when using fretted instruments to actuate bass accompaniment.

According to one embodiment of the present invention, a system is described as including a fully functional electric guitar instrument, certain frets of which are divided into sections that output to a switching component. When the user fingers instrument strings to designated fret sections, a switching component sends note selection data to a synthesizer housed in an external interface. A floor unit includes actuators or pressure-activated switches that output to the synthesizer. The user taps on the actuators with his or her feet and thereby actuates accompaniment notes that are generated in the rhythms in which they are tapped. The user may tap to generate notes in rhythms that are typical of traditional bass accompaniment or other accompaniment instruments. Bass or other accompaniment notes generated by the process are designated by notes and chords being fingered on the instrument. Methods and functions that facilitate the simulation of traditional bass accompaniment are also described.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the description serve to explain the principles of the invention. Furthermore, the accompanying drawings illustrate methods of the invention and together with the description serve to explain the principles of the methods.

FIG. 5 is a table showing designated fret sections.

FIG. 6A is a table showing an example of coordinates associated with a first switching method.

FIG. 6B is a table associated with a note cancellation function.

FIG. 7 is a table showing an example of coordinates associated with a second switching method.

FIG. 9 is a table showing examples of presets coordinates according to a method for generating accompaniment notes.

DETAILED DESCRIPTION OF EMBODIMENTS

Reference will now be made in detail to particular methods and embodiments of the present invention, examples of which are illustrated in the accompanying drawings.

Rhythm and Note Designation

Accompaniment notes are actuated by the tapping on one or more fret-designated transducers using the feet or hands. The rhythm that is "tapped out" is the rhythm in which the bass or accompaniment sound is generated. The rhythm with which the user strums or plucks the strings of the instrument is not reflected in the rhythm of the accompaniment notes. Rather, the rhythm of the accompaniment notes is generated according to the rate at which the fret-designated actuator is tapped out, e.g., by the user's feet. The fingered notes or chords on the instrument designate the MIDI note #'s, which identify the accompaniment notes for sound production by the synthesizer. Hence, the user's fingering designates the accompaniment notes and/or sounds, while the tapping of the fret-designated actuator creates the rhythm for the designated accompaniment notes. This allows the instrumentalist, e.g., guitarist, to produce two rhythms: the first produced from strumming or plucking the instrument strings, and the second produced by tapping the fret-designated actuator with the accompanying notes or sounds designated by the fingering. Alternatively, the fret-designated actuator may be tapped by a second musician, e.g., a percussionist. In this example, a first musician sets the first rhythm by plucking or strumming the strings and also designates the accompanying notes by the fingering, and the second musician sets the second rhythm by tapping on the fret-designated actuator according to the desired rhythm accompaniment.

Note-Assigned Floor Transducer

Preferably, a note-assigned transducer is also included. The note-assigned transducer, like the fret-designated transducer, allows a separate rhythm to be produced. However, in contrast to the fret-designated transducer, the accompaniment note is pre-programmed by the user, as opposed to being designated by the fingering. This allows the instrumentalist to tap out a frequently occurring note during a performance regardless of the fingering.

Two Examples

Figure 1A:
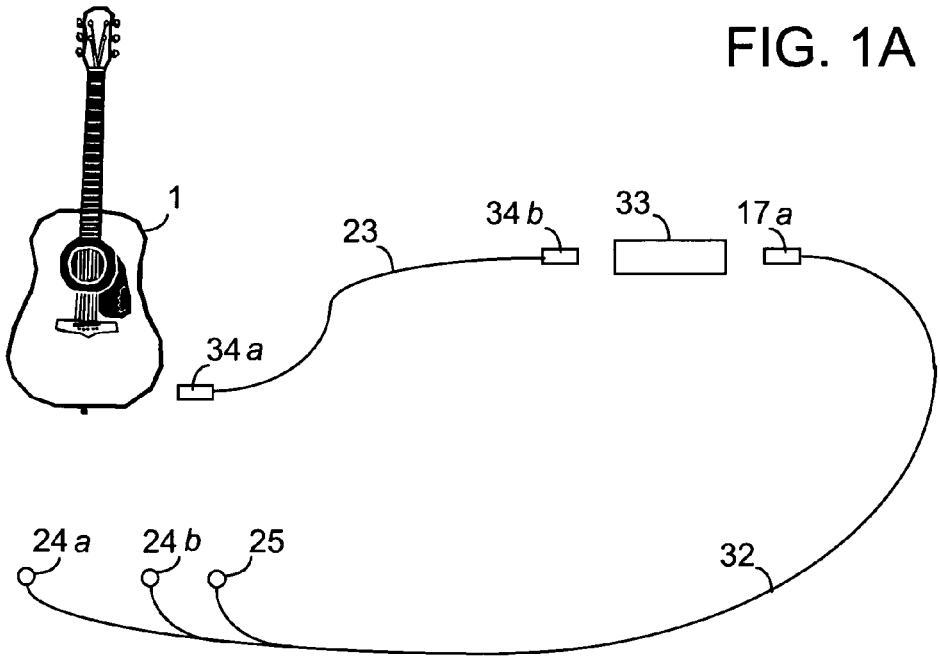
FIGS. 1A & 1B show overviews of the fretted instrument, transducers, connecting cables, and external interface according to Embodiments A and B.
Figure 1B:
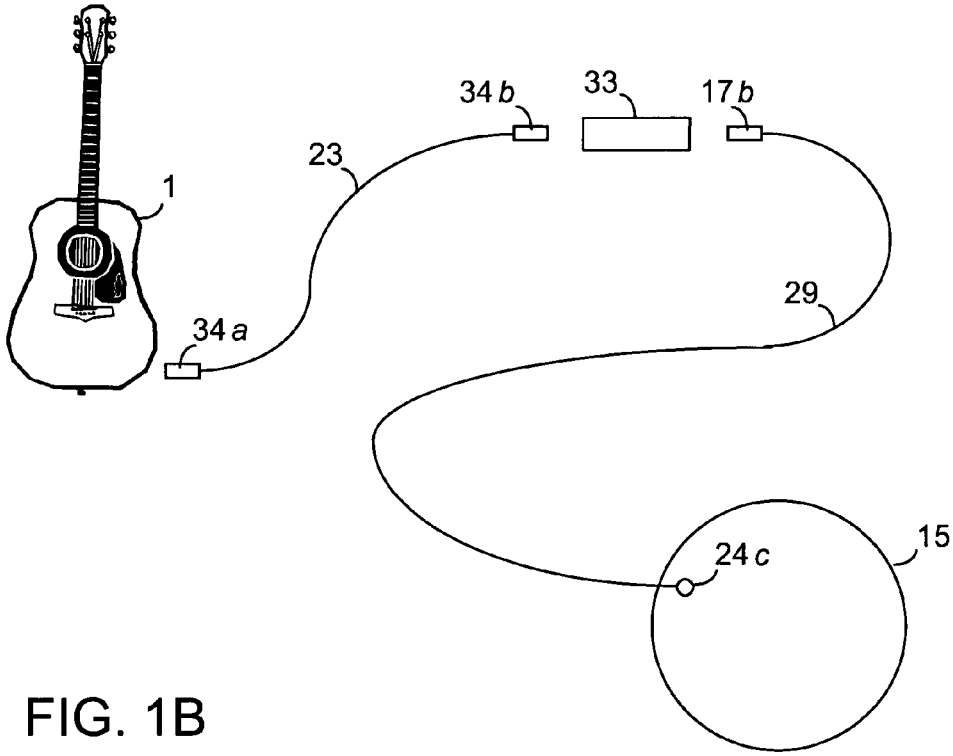
Figure 2:
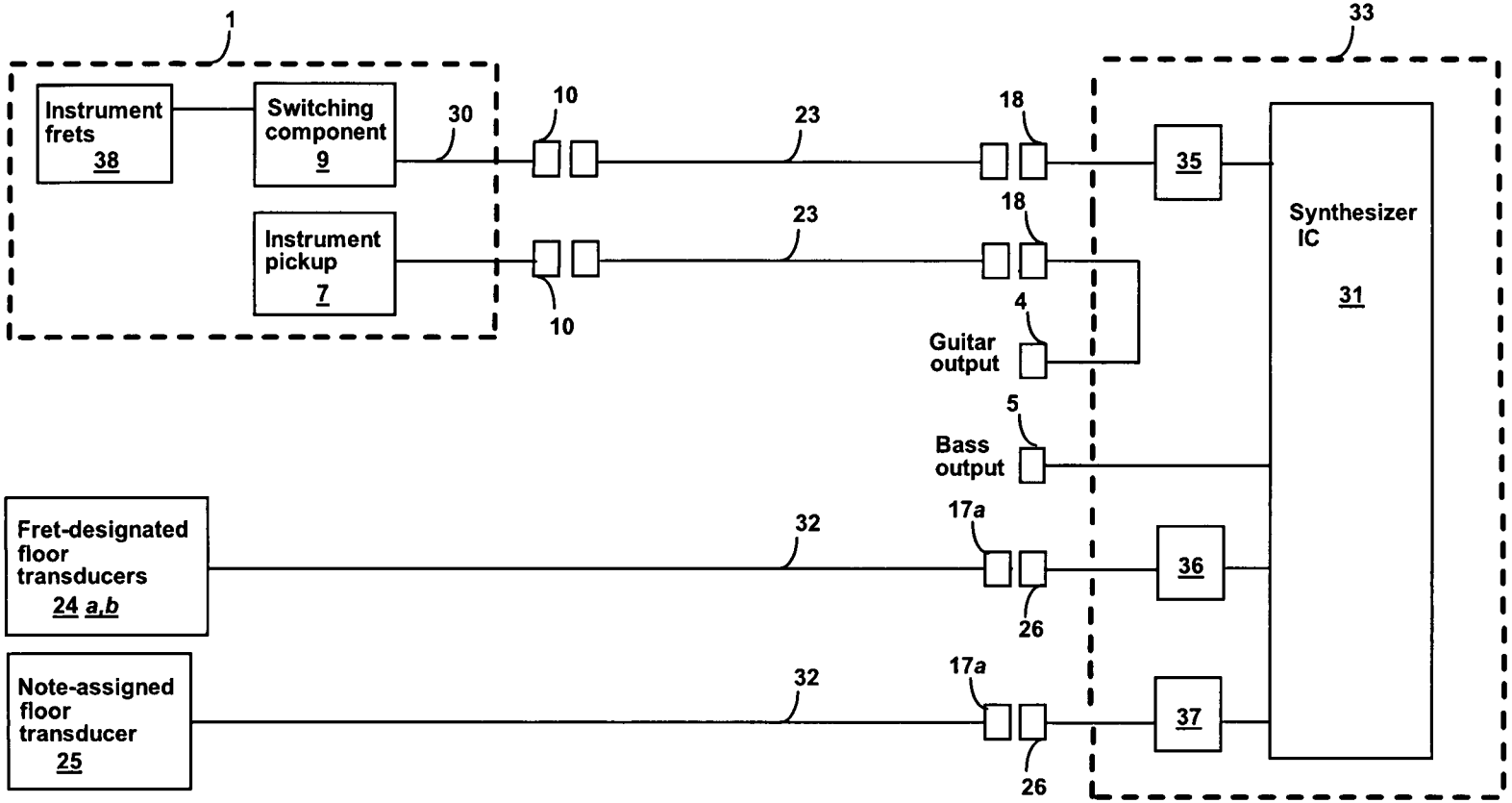
FIG. 2 shows components and connections of Embodiment A.

FIGS. 1A, 1B and FIG. 2 show components and connections associated with the fret-designated floor transducers 24*a,b*. Each tap by the user on one or both of the fret-designated floor transducers 24*a,b* actuates a designated accompaniment note stored in a synthesizer IC chip as determined from the fingering on the guitar. Selection of the accompaniment note is designated by MIDI note # data sent from a switching component 9 to the synthesizer IC chip 31 when instrument strings contact designated instrument fret sections.

Using Note-Assigned Floor Transducers

A note-assigned floor transducer 25 is useful when the user requires direct actuating of a bass note to accompany a chord that may be difficult to finger or that is not designated by the chord that is being fingered on the instrument when the transducer is tapped. For example, the user may assign MIDI note #35 (a B note) to the note-assigned floor transducer by programming the data into Preset #1 in the memory of the synthesizer microchip 31. As long as Preset #1 is accessed, the user may tap the note-assigned floor transducer 25 to actuate the B accompaniment note at any time to accompany any chord. Any accompaniment note or sound that is stored in the microchip memory may be assigned to the note-assigned floor transducer 25.

Operation by One Person

FIG. 1A shows components and connections of Embodiment A. In this embodiment, accompaniment notes are actuated by the tapping of the foot of the person who is playing the guitar 1. This fretted musical instrument 1 pickup and internal interface unit output signals are transferred through the instrument's multi-contact receptacle (not shown) through multi-contact connectors 34*a,b* and multi-channel cable 23 to a multi-contact receptacle (not shown) in an external interface 33, which includes the synthesizer IC. Floor transducers 24*a, b,* 25 output through multi-channel cable 32 and multi-contact connector 17*a* to a receptacle (not shown) in the external interface 33.

Operation by Two Persons

FIG. 1B shows components and connections of Embodiment B. This embodiment utilizes a guitarist and percussionist simultaneously operating the system. In this example, the percussionist sets the rhythm for accompaniment by tapping the transducer 24*c*. The MIDI note #'s of bass or accompaniment notes actuated in Embodiments A and B depicted in FIGS. 1A and 1B are designated by the notes or chords that are being fingered on the instrument 1. When using Embodiment B depicted in FIG. 1B, accompaniment notes are actuated by the tapping of the foot of a drummer of the musical ensemble. For example, after attaching the transducer 24*c* to the bass drum of a drum set, the drummer plays the drum set as he or she would normally play during a performance. Accompaniment notes generated by this application are generated in the rhythm of the tapping of the bass drum by a drum beater foot pedal or by an equivalent of the process, such as the tapping of the drummer's foot on a simulator of a bass drum beater such as those commercially available from Roland, Inc. Transducer 24*c* attaches with double-sided adhesive strip or other fastener (not shown) to the bass drum 15 of a drum set for operation by a person other than the player of the guitar 1. Output signals from the guitar 1 pickup and internal interface unit are transferred through the instrument multi-contact receptacle (not shown) through multi-contact connectors 34*a,b* and multi-channel cable 23 to a multi-contact receptacle (not shown) in the external interface 33. The fret-designated transducer 24*c* outputs through cable 29 and connector 17*b* to a receptacle (not shown) in the external interface 33. Transducers may be attached to any drum or surface and may be actuated by tapping with a foot, hand, drumstick or other appropriate actuating process.

FIG. 2 shows in detail the components and connections of Embodiment A. Selected instrument fret sections 38 are connected to a switching component 9 that determines from the instrument fingering at the fret sections 38, the MIDI note # data 30 sent to the synthesizer IC 31. This MIDI data is communicated through an instrument output receptacle 10, which is in communication with a receptacle 18 of the signal conditioning circuitry 35 of the external interface 33 through a multi-channel connecting cable 23. Output from the instrument's standard pickup 7 may also be communicated through the instrument output receptacle 10, multi-channel connecting cable 23 and receptacle 18 so that a standard guitar amplifier, e.g., Fender Twin Reverb amplifier, can be connected through an output jack 4 provided on the external interface 33. Output from the fret-designated floor transducers 24*a,b* and note-assigned floor transducer 25 are sent to signal conditioning circuits 36, 37 respectively, through receptacles 17*a*/26 via multi-channel cable 32. The synthesizer IC 31 may be a standard programmable synthesizer IC microchip such as those available from Kurzweil, Inc. (Lakewood, Wash.). Synthesizer bass or accompaniment notes are output through a bass output jack 5 that provides a connection to a standard bass amplifier, such as a Fender Bassman.

A MIDI receptacle (not shown) included on a front panel of the external interface 33 provides a connection to a commercially available MIDI foot controller to access presets during performances. A scroll-up/scroll-down switch input receptacle (not shown) on the front panel of the external interface 33 is included for connection of a cable to a dual floor switch to provide scrolling up or down when accessing presets. An LED readout (not shown) included on the front panel of the external interface 33 provides a readable indication of the accessed preset. Parameter controls (not shown) on the front panel of the external interface 33 provide user programmable adjustment of floor transducers to account for sensitivity and set threshold parameters. The adjustment may be used to limit the input signal, thereby limiting the generating of extraneous bass notes when a transducer is attached to a particularly resonant or responsive drum. Components commonly known as limiters or gates may be utilized for transducer threshold and sensitivity adjustment. The external interface 33 may include controls (not shown) that facilitate the programming of functions, as will be understood.

Figure 3:
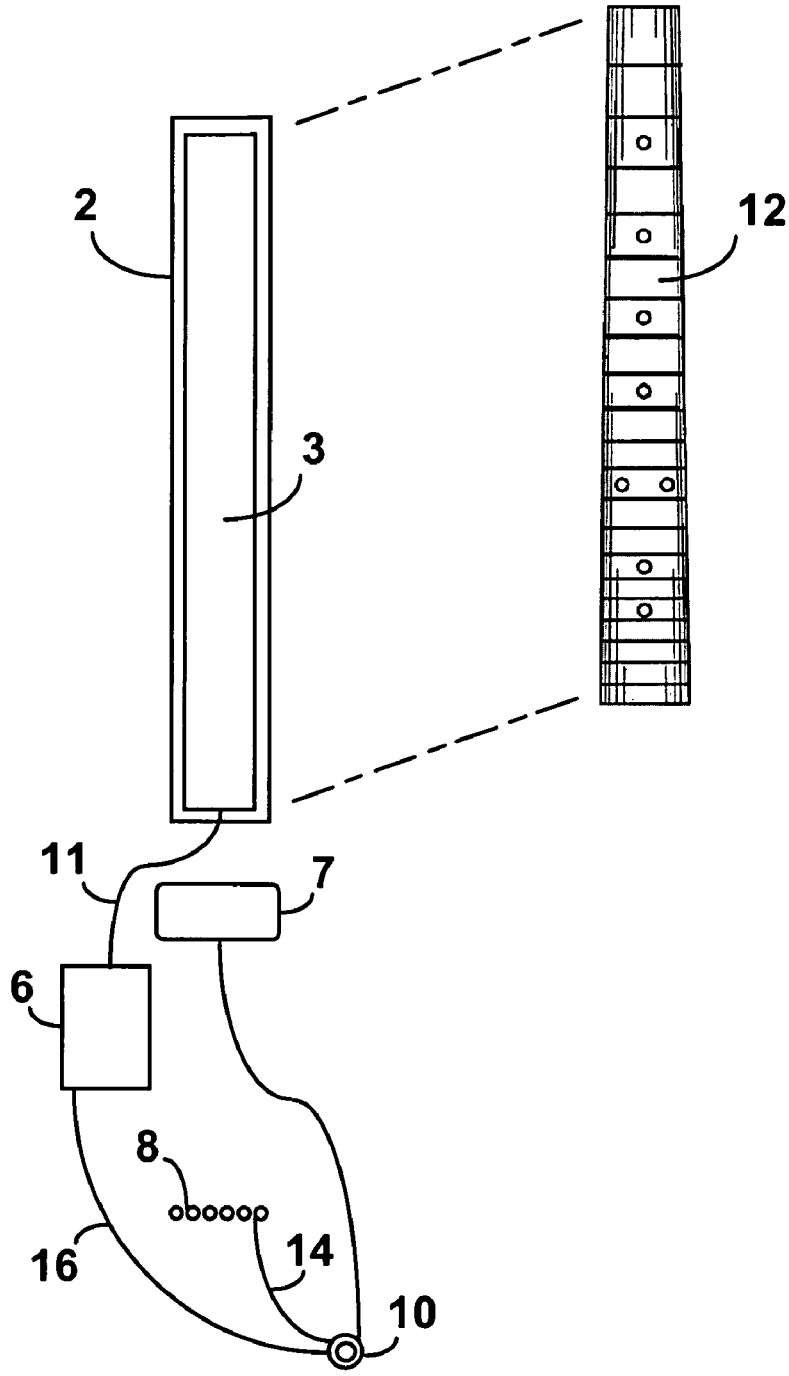
FIG. 3 shows inner components of the instrument neck and body.

FIG. 3 shows components of the instrument neck 2 and body. The instrument pickup 7 outputs to the output receptacle 10 mounted on the instrument body. Selected fret sections 38 are each connected to a wire or a printed circuitboard 3 located beneath the fingerboard 12, which is shown disconnected from the instrument neck 2 in FIG. 3 for illustrative purposes. A multi-channel cable 11 connects the circuitboard 3 to the switching component 9 (FIG. 2), which is represented in FIG. 3 by housing 6. The switching component 9 sends MIDI note data to the output receptacle 10 through wires 16. Output from the instrument's pickup 7 is also sent through output receptacle 10. The switching component 9 selects the MIDI note # that is passed to the IC 31 based on the fingering of designated fret sections 38, as explained in greater detail below.

String endpins (not shown) made of brass or other electrically conductive material insert into stringpin contacts 8. V+ from a low-voltage battery, such as a 9V battery, that is housed in the external interface (not shown), applies a voltage to each of the instrument strings through contact wires 14. This voltage is used to energize a circuit in the switching component 9 associated with a fret section designated by the fingering, for purposes of communicating designated fret sections to the switching component 9. Stringpin contacts 8 are normally used for hollow-body guitars to apply this voltage. Bridge contacts (not shown) are substituted for the stringpin contacts 8 when an archtop guitar such as a Gibson ES-335 or a solid body guitar such as a Fender Stratocaster or equivalent is modified as described and depicted herein. Guitar strings (not shown) coated with phosphor bronze or other electrically conductive alloy are included, such as strings commercially available from Martin Guitar Co. A pickup output receptacle (not shown) for direct connection of a standard cable to a standard guitar amplifier, such as a Fender Twin Reverb, for amplification of the instrument pickup may be included on the guitar when the accompaniment systems of the illustrated embodiments are not being used.

Figure 4A:
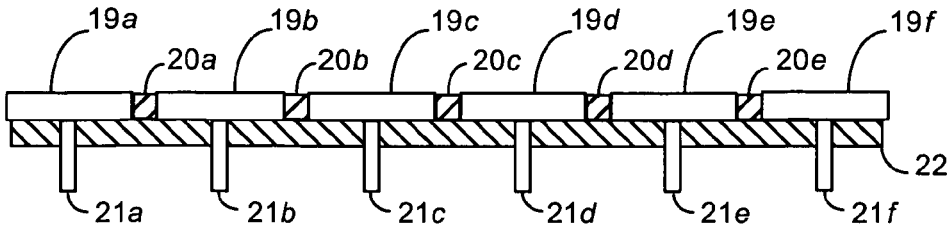
FIG. 4A shows a side view of an example of a fret of the instrument.

FIG. 4A shows details of a side view of an example of a fret for an instrument. The pictured fret depicts six fret sections corresponding to a single fret on the instrument neck, although fewer fret sections are chosen in the illustrated embodiments. Fret sections 19*a-f* are composed of electrically conductive material isolated from one another with electrically non-conductive material or voids 20*a-e* between each fret section. Fret posts 21*a-f* are composed of electrically conductive material to connect fret sections to wires or to the instrument printed circuitboard 3 (FIG. 3). Fret rail 22 is composed of electrically non-conductive material which secures fret sections to the instrument fingerboard 12 (FIG. 3).

Figure 4B:
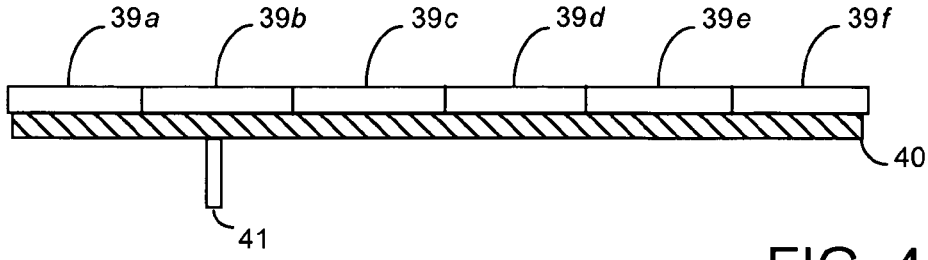
FIG. 4B shows a side view of an example of a fret of the instrument.

FIG. 4B shows details of a side view of another example of a fret for an instrument. A standard guitar fret is depicted, such as those found on a traditional guitar. In this example, each of the fret sections 39*a-f* is a region of the fret that contacts one of the instrument strings when fingered, i.e., the fret section depicted as 39*a* contacts the low E-string when fingered, fret section 39*b* contacts the A-string when fingered, etc. The pictured fret depicts six fret sections corresponding to a single fret on the instrument neck, although fewer fret sections are chosen in the illustrated embodiments. Fret rail 40 is composed of electrically conductive material which secures the fret to the instrument fingerboard 12 (FIG. 3). Insulated electrical wire 41 connects the fret to the switching component 9 (FIG. 2) which is represented in FIG. 3 by housing 6.

FIG. 5 is a table showing an example of delineations of fret sections and fret locations on the fingerboard of the instrument as related to the fingering. Columns 1-5 indicate the fret sections for instrument strings 6 through 2, respectively, i.e., the E, A, D, G and B strings for a standard guitar tuning. Fewer or more instrument fret sections may be designated for wiring and for inclusion in the instrument. Frets of the high E-string do not designate accompaniment notes in the embodiments described and depicted herein, although frets of the high E-string or any other fret or fret section on the instrument may be wired or connected to the system and included in the accompaniment note selection process. Thus, according to this example, fingering at any of the twelve consecutive fret locations along the neck 2 for the E and A strings activates or designates a respective E or A fret section (E1 through E12 and A1 through A12, a total of 24 fret sections), fingering at each of the second and third fret locations for the D and G strings (D2, D3, G2 and G3, a total of 4 fret sections), and the third fret location for the B string (B3, one fret section).

Switching Component

The switching component 9 as shown in FIG. 2 is used to select the MIDI note # from a particular fingering of fret sections. When a fret section is fingered, a normally open relay switch associated with that fret section on a circuitboard (not shown) in the switching component 9 is closed. At least one relay switch is associated with each fret section. When the relay switch is closed, the resulting closed circuit communicates to a MIDI component (not shown) the fret section and therefore the note on the fingerboard that is designated by the fingering. The MIDI component converts the fret data into a MIDI note # that is sent to the synthesizer IC 31. In one embodiment, the circuitry is configured such that at least two fret sections must be designated in order to produce a MIDI note #, which can occur simply by fingering one fret on a string, e.g., an E3 fingering designates E3 and E2 fret sections. Once the selected MIDI note # is communicated to the IC 31 from the switching component 9, the system waits for a tapping of the transducer to actuate the accompaniment note.

The switching component 9 may be programmed to scan or monitor each string individually to ascertain the address of a closed relay switch. This switching method is appropriate for use with an instrument that is equipped with standard frets as depicted in FIG. 4B, with each fret being in communication with the switching component 9. Hence, when a string is fingered, fret section data (e.g., E1, E2, etc.) is communicated to the switching component 9 as data comprised of the coordinates of the fingered string (e.g., E, A, D, etc.) followed by the fret number (e.g., 1, 2, etc.) to which the designated string is pressed. String/fret coordinates that may be applied to this switching method are shown as a table in FIG. 5.

Extraneous Notes and/or Note Selection

Reference will now be made in detail to preferred methods for obviating the generation of extraneous notes and/or note selection resulting from a fingering. The methods described herein are compensatory functions directed to facilitating the simulation of traditional bass accompaniment for anticipated fingering patterns and/or chord progressions. The methods are preferably implemented by tables or associations programmed into the switching component 9, which map MIDI note #s to various combinations of designated fret sections resulting from corresponding fingerings on the instrument neck (as may be communicated through relay switches of a circuitboard). Generally speaking, this disclosure contemplates and illustrates through examples that fingerings may be logically mapped to a MIDI note # suited for accompaniment for various chord forms on the instrument neck. For example, in one embodiment three algorithms, or switching methods, programmed into the switching component 9, are used to select MIDI note numbers: an Adjacent Fret Section/Adjacent String Cancellation ("AFS/ASC") switching method, a Multi-String Selection ("MSS") switching method and a Note Cancellation Function ("NCF"). In the AFS/ASC and MSS methods, a MIDI note # is selected from a pair of designated fret sections, although more fret sections may also be used to select a MIDI note #. The NCF is used to turn-off an accompaniment note.

Figure 8:
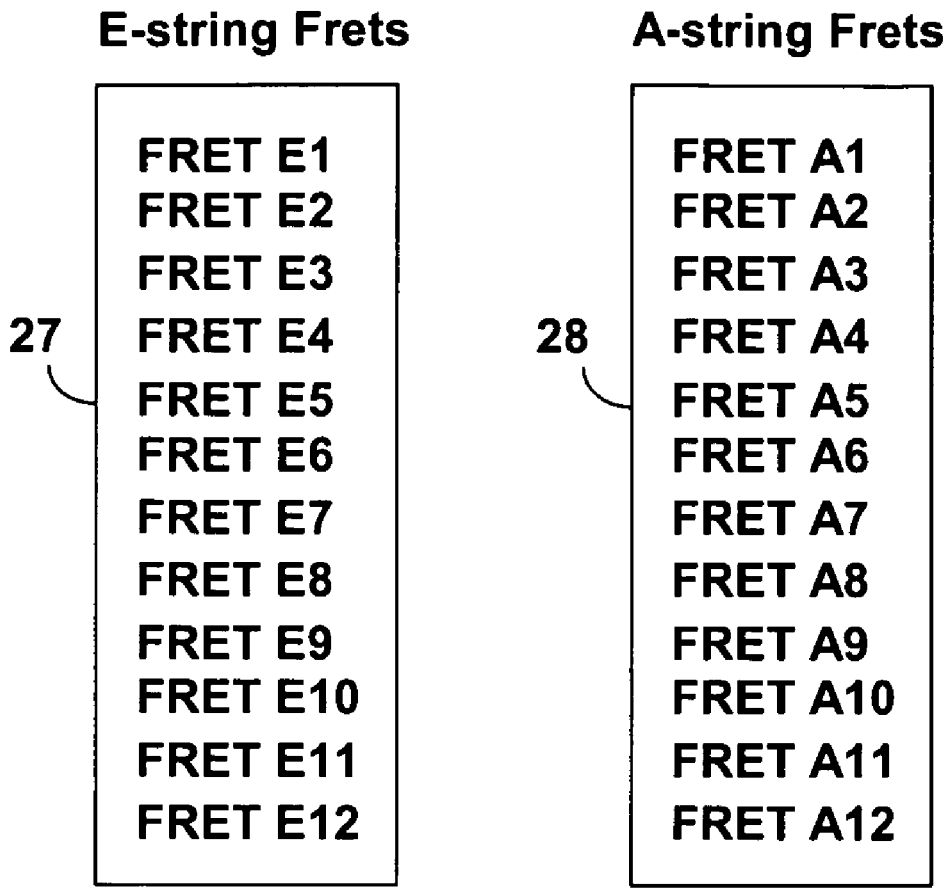
FIG. 8 shows an example of coordinates also associated with the second switching method.

The AFS part of AFS/ASC selects the MIDI note # based on pairs of adjacent frets fingered on the same string, e.g., the fret pairs E3 and E2 when E3 is fingered, and the ASC part prioritizes E-string fingering over A-string fingering. FIG. 7 is a table showing the fret pairs corresponding to each MIDI note # and FIG. 8 shows the prioritizing of E string fingering 27 over A string fingering 28. The AFS/ASC method in this embodiment generates a MIDI note # only when the E or A string is fingered (the other strings are ignored). Thus, a MIDI note # is selected based on the A string fingering, unless the E string is also fingered (in which case the note # corresponding to the E string fingering is used). Thus, for example, when a first position G chord is fingered (E3, A5, D5, etc.), the root G note designated by the E string fret sections E3, E2 takes precedence over the A string fret sections A5, A4. The switching component 9 then communicates MIDI note #31 to IC 31 (E3 and E2 are designated), which is a G (corresponding to the root note of a first position G chord). The A5 and A4 designations are ignored since the E string is fingered. If instead of the G chord, a D chord were formed with A5 being fingered and the E string left open, then MIDI note #38 (D) would be sent to the IC 31 as the adjacent fret sections in this case are A5 and A4.

Preferably, the AFS/ASC method chooses the lowest pitch string that is fingered, since this fingering typically forms the root of the chord in popular music. Thus, wherever the first position bar chord (whether it be a major, minor, dominant seventh, or other variation) is formed along the neck of the instrument, the switching component 9 can select the appropriate accompaniment note based on the fret pairs in contact with the low E string. If the E string is not fingered, then the fret pairs for the A string are used to select the MIDI note # which can correspond to a second position bar chord, e.g., D chord formed by A5, D7, G7, etc.

The MSS switching method is used for chord forms that have a fingered note designated in the lowest pitch string that is not the desired accompaniment note. In contrast to the AFS/ASC method, the MSS switching method selects a MIDI note # from fret sections designated from a plurality of string fingerings, as opposed to a single string under the ASC/AFS method. The MSS method can override MIDI note # selection under AFS/ASC depending on the fret sections designated or not designated. However, in this example, under no condition can the MSS override the AFS/ASC method when the E string is fingered.

FIG. 6A illustrates four examples of designated fret sections that can result in MIDI note # selection under the MSS method. For example, in FIG. 6A first row, A2 and D2 are fingered, which is a B and E note of the E chord, respectively. The AFS/ASC method would normally choose MIDI note

#35 (B) from this fingering, because the B note is in the A string. However, an E note accompaniment is desired because an E chord is suggested by the fingering of A2 and D2. In this situation, the MSS method instead chooses MIDI note #28 (E note) since the fifth and root of the E chord are being fingered (A2 and D2), as opposed to the root and fifth of a B chord. In example two (second row), the A string is not fingered. Rather D3 and G2 are fingered, which are the third and root of an F chord. From this pair of designated fret sections, the MSS method selects MIDI note #29 (F) since the fret sections suggest that an F chord is being played. Examples 3 and 4 show similar logic for selecting A and D notes, respectively from designated fret section pairs. These examples are intended to illustrate how algorithms can be used to prioritize over note selection based on fingering across multiple strings. In the foregoing non-limiting examples, the MSS method selects the MIDI note # when the fingering on one or more other strings precludes the root, fifth or other element of a chord or complimentary note to the chord from being in the A string, or when the A or E string is not being fingered. Again, it will be understood from the foregoing that the algorithm chosen is a matter of preference to the musician and his or her playing style, and not a limitation on the scope or spirit of the invention.

Thus, the foregoing examples of switching methods, which are based on playing styles for popular music, e.g., rock, assume a progression that normally has a root or fifth formed by the lower pitch strings. It should also be noted that the switching component 9 may be programmable so that a user can select among different algorithms for selection of the accompaniment note based on a particular choice of chord formations, keys, progressions and/or playing styles, e.g., first, second, third, etc. chord formations, chords which have a note other than a root, third or fifth of the triad fingered by the lower pitch string, etc.

The Note Cancellation Function ("NCF") is used to turn-off the accompaniment note that is produced when the fret-designated transducer 24*a,b* is tapped. This may be useful when no accompaniment is desired, but the musician is likely to continue to tap the transducer, e.g., to keep a beat or when transducer 24*c* is secured to a percussion instrument, or when a chord is fingered which does not result in a desired MIDI note selection. FIG. 6B illustrates four examples. When an E note is produced from a tapping of the transducer, but this note is no longer desired, a fingering of A3 (C) will signal to the IC 31 that the E note accompaniment should be discontinued. Similarly, G3 (Bb) will discontinue an F, A or D accompaniment.

Note Inclusion Function

In another embodiment, a programmable Note Inclusion Function ("NIF") in the presets may be desirable in order to eliminate discordant accompaniment notes from the note selection process. Specifically, the NIF limits the available accompaniment notes in each preset to a subset of notes that the user programs into the synthesizer IC memory. Presets are programmed, named or numbered by the designer or the user for reference and access. To accompany a song such as LaBamba by Richie Valens that is comprised of chords C, F and G, the user would access the preset that includes only the C, F and G accompaniment notes, such as the depicted preset that is named FGC in FIG. 9. To accompany another song on the user's list, such as Your Cheatin' Heart by Hank Williams, the user would access a preset that is comprised of accompaniment notes that reflect the chords of Your Cheatin' Heart, such as the depicted preset that is named GCDE. Presets may be arranged in the order in which they are accessed and the order may be saved as a chain in the memory of the synthesizer IC 31 microchip.

FIG. 9 shows a table of examples of note inclusion coordinates for presets stored in the synthesizer IC 31 microchip. The table shows a partial list of the many unique subsets of accompaniment notes in presets that may be stored in the microchip for access. The bass notes F, Gb, G, Ab, A, Bb, B, C, Db, D, Eb, and E included for generation in each of the listed presets are indicated by the "ON" designation in the respective vertical columns under note names, and notes excluded from each of the presets are indicated by an "X" designation.

Presets may be accessed by the user through the use of one of any commercially available MIDI controllers or momentary switches that are designed for operation with the foot. A MIDI receptacle is included on the front panel of the external interface 33 to provide connection of a standard MIDI cable. A preset scroll-up/scroll-down switch receptacle is included for connection of a standard TRS cable to dual floor switches to provide scrolling up or down when accessing presets.

Exclusive-Note Function

Traditional bass accompaniment is played in single notes, that is, rarely are two or more simultaneous bass notes sounded at any time during a performance on a bass guitar or bass fiddle. To integrate this characteristic, the synthesizer IC 31 microchip includes a function that precludes the generating of simultaneous or overlapping bass notes. Each note that is generated interrupts the previous generated note and generates for the designated note duration or until it is interrupted by a subsequent generated note.

Programmable Note-On Duration Function

Bass accompaniment notes generated by the system are five seconds in duration, however, the duration of each prerecorded synthesized accompaniment note is programmable and can be increased or decreased by the user. Note duration parameters are stored in presets in the memory of the synthesizer IC microchip.

Additional Ramifications

In the embodiments described herein, piezoelectric transducers, commonly known as acoustic drum triggers, are utilized as actuators for the generating of bass notes or accompaniment sounds. A microphone, pickup, drum, audio signal, momentary switch, electrical current, MIDI data generator or other appropriate actuator may be used in place of the transducers to actuate bass notes or accompaniment sounds that are stored within the memory of the synthesizer microchip or sound generator in other embodiments of the invention.

In the embodiments described herein, bass notes are described as the designated accompaniment sounds. However, prerecorded piano chords, guitar chords or any appropriate accompaniment sound, combination of sounds or sequence of sounds may be programmed into the memory of the synthesizer microchip or sound generator for actuating in other embodiments of the invention.

In the embodiments described herein, MIDI note # data is utilized as the note selection data that is sent from the switching component 9 to the synthesizer or sound generator 31. Note selection data such as pitch data, waveform data, frequency data or other appropriate data may be utilized for selection of bass or accompaniment notes in other embodiments.

In the embodiments described herein, twenty-nine fret sections are designated for connection to the switching component 9. Fewer or more fret sections may be included or designated in other embodiments.

In the embodiments described herein, coordinates that designate the selection of bass notes or accompaniment sounds are appropriate only for standard tuning of the guitar instrument. Certain components may be programmed for selection of appropriate bass notes or accompaniment sounds when alternate tunings of the instrument are employed.

Therefore, although this invention and these methods have been described with a certain degree of particularity, it is to be understood that the present disclosure has been made only by way of illustration and that numerous changes in the details of construction and arrangement of parts may be resorted to without departing from the spirit and scope of the invention.

What is claimed is:

1. A system for generating an accompaniment note during a musical performance, comprising:

a synthesizer capable of generating at least one of a plurality of notes;

a split fret stringed instrument having at least two fret sections, the split fret stringed instrument being configured for identifying a fingering of at least one note or chord by the at least two fret sections wherein the at least one note or chord has a first rhythm;

a note selection component in communication with the at least two fret sections and the synthesizer, the note selection component being configured to select at least one accompaniment note based on the designated at least two fret sections and communicating the selected accompaniment note to the synthesizer; and a pressure-actuated switch in communication with the synthesizer and configured to cause the synthesizer to generate the selected at least one accompaniment note in a second rhythm independent of the rhythm of the at least one note or chord.

2. The system of claim 1, wherein each fret section is a region of a standard guitar fret, with each region being capable of designating one of the instrument strings to a switching component when fingered.

3. The system of claim 1, wherein each fret section is electrically insulated from an immediately adjacent fret section.

4. The system of claim 1, wherein each fret section is in electrical conductance with an immediately adjacent fret section.

5. A method for producing a rhythm accompaniment for an instrument, comprising:

providing a note selection component adapted for detecting a fingering of at least one note or chord having a first rhythm on a split fret stringed instrument;

providing a synthesizer in communication with the split fret stringed instrument and a pressure-actuated switch for producing an accompaniment note having a second rhythm independent of the first rhythm;

selecting an accompaniment note based on the detected fingering of at least one note or chord having a first rhythm and communicating that note to the synthesizer; and generating the accompaniment note having a second rhythm independent of the first rhythm wherein the second rhythm corresponds to the sequence in which the pressure-actuated switch is actuated.

6. The method of claim 5, wherein generating further includes generating first and second rhythms by the same person.

7. The method of claim 5, wherein the first rhythm is generated by a first person and the second rhythm is generated by a second person.

8. A method for producing an accompaniment sound, comprising:

providing a split-fretted stringed instrument and a pressure-activated actuator;

detecting a fingering on the split-fretted stringed instrument and from that detected fingering, selecting the accompaniment sound;

communicating the selected sound to a synthesizer; and producing the accompaniment sound having an accompaniment rhythm determined by a signal from the pressure-activated actuator.

9. The method of claim 8, further including tapping on the pressure-activated actuator to produce the rhythm using the selected sound.

10. The method of claim 8, further including producing a first rhythm on the split-fretted stringed instrument independent of the accompaniment rhythm using the selected accompaniment sound.

11. A system for selecting an accompaniment, comprising:

a split fret stringed instrument;

a sound selection component configured to select at least one of a plurality of accompaniment sounds based on a fingering of at least one note or chord having a first rhythm on the split fret stringed instrument; and at least a first and second circuit adapted for communicating a respective designation of a first and second fret section from the fingering of at least one note or chord having a first rhythm to the sound selection component;

wherein the sound selection component selects an accompaniment sound from the plurality of accompaniment sounds when at least both of the at least first and second fret sections are designated; and a pressure-actuated switch configured to (a) actuate the generation the at least one of a plurality of accompaniment sounds and (b) to cause the generated at least one of a plurality of accompaniment sounds to have a second rhythm independent of the rhythm of the at least one note or chord.

12. The system of claim 11, wherein the accompaniment sound is a note present in a fingered chord identified by the designated first and second fret sections.

13. The system of claim 11, further including a sound generation device including a synthesizer configured to communicate with the split fret stringed instrument to produce the at least one of a plurality of accompaniment sounds and configured to communicate with the pressure-actuated switch to produce the second rhythm using the selected sound, wherein the second rhythm is independent of the first rhythm produced by the split fret stringed instrument.

14. The system of claim 11, wherein the sound selection component is configured to associate at least two designated fret sections with a chord based on at least a first and second note of the chord represented by the respective at least two designated fret sections.

15. The system of claim 11, wherein the sound selection component is configured to select a sound based on the note represented by the fret section corresponding to a fingering of the lowest pitched string of the instrument.

16. The system of claim 11, further including a third and fourth circuit adapted for communicating a respective designation of a third and fourth fret section, the note selection component is in communication with the first, second, third and fourth circuits, and a first and second sound is associated with the respective first and second fret sections and third and fourth fret sections;

wherein when both the first and second fret sections and the third and fourth fret sections are designated by the fingering, the note selection component is configured to select the second sound.

17. The system of claim 16, wherein a lowest pitch string that is fingered on the instrument corresponds to the third and fourth fret section.

18. The system of claim 16, wherein the sound selection component is further configured to discriminate the first and second designated fret sections from at least the third and fourth designated fret sections based on at least a pair of notes identifying a chord from the designated fret sections, and to select the sound complimenting the fingered chord.

19. The system of claim 11, wherein each fret section is a region of a standard guitar fret, with each region being capable of designating one of the instrument strings to a switching component when fingered.

20. The system of claim 11, wherein each fret section is electrically insulated from an immediately adjacent fret section.

* * * * *